US008016054B2

(12) United States Patent
Lancaster et al.

(10) Patent No.: US 8,016,054 B2
(45) Date of Patent: Sep. 13, 2011

(54) POLYCRYSTALLINE DIAMOND ABRASIVE ELEMENTS

(76) Inventors: Brett Lancaster, Boksburg (ZA); Bronwyn Annette Roberts, Parkhurst (ZA); Imraan Parker, Cape Town (ZA); Roy Derrick Achilles, Bedfordview (ZA)

( * ) Notice: Subject to any disclaimer, the term of this patent is extended or adjusted under 35 U.S.C. 154(b) by 718 days.

(21) Appl. No.: 10/558,490

(22) PCT Filed: May 27, 2004

(86) PCT No.: PCT/IB2004/001751

§ 371 (c)(1),
(2), (4) Date: May 21, 2008

(87) PCT Pub. No.: WO2004/106004

PCT Pub. Date: Dec. 9, 2004

(65) Prior Publication Data

US 2008/0222966 A1 Sep. 18, 2008

(30) Foreign Application Priority Data

May 27, 2003 (ZA) ..... 2003/4096
Nov. 7, 2003 (ZA) ..... 2003/8698

(51) Int. Cl.
*E21B 10/42* (2006.01)
*E21B 10/62* (2006.01)

(52) U.S. Cl. ..... 175/327; 51/293; 51/307; 51/309; 327/425

(58) Field of Classification Search ..... 51/307, 51/309, 293; 175/327, 425
See application file for complete search history.

(56) References Cited

U.S. PATENT DOCUMENTS

| | | | | |
|---|---|---|---|---|
| 4,224,380 | A | 9/1980 | Bovenkerk et al. | |
| 4,255,165 | A | 3/1981 | Dennis et al. | |
| 4,604,106 | A | 8/1986 | Hall | |
| 4,690,691 | A | 9/1987 | Komanduri | |
| 4,861,350 | A | 8/1989 | Phaal et al. | |
| 5,127,923 | A | 7/1992 | Bunting et al. | |
| 5,351,772 | A * | 10/1994 | Smith | 175/428 |
| 5,435,403 | A | 7/1995 | Tibbitts | |
| 5,468,268 | A | 11/1995 | Tank et al. | |
| 5,486,137 | A | 1/1996 | Flood et al. | |
| 5,492,188 | A | 2/1996 | Smith et al. | |

(Continued)

FOREIGN PATENT DOCUMENTS

JP 59-219500 12/1984

(Continued)

OTHER PUBLICATIONS

Abstract of European Patent Publication No. EP 0196777, dated Oct. 8, 1986.

*Primary Examiner* — Jerry Lorengo
*Assistant Examiner* — Jared Wood
(74) *Attorney, Agent, or Firm* — Scully, Scott, Murphy & Presser, P.C.

(57) ABSTRACT

A polycrystalline diamond abrasive element, particularly a cutting element, comprises a table of polycrystalline diamond bonded to a substrate, particularly a cemented carbide substrate, along a non-planar interface. The polycrystalline diamond abrasive element is characterised by the nonplanar interface having a cruciform configuration, the polycrystalline diamond having a high wear-resistance, and the polycrystalline diamond having a region adjacent the working surface lean in catalysing material and a region rich in catalysing material. The polycrystalline diamond cutters have improved wear resistance, impact strength and cutter life than prior art cutters.

11 Claims, 5 Drawing Sheets

U.S. PATENT DOCUMENTS

| | | | | |
|---|---|---|---|---|
| 5,505,748 | A * | 4/1996 | Tank et al. | 51/293 |
| 5,590,729 | A | 1/1997 | Cooley et al. | |
| 5,971,087 | A | 10/1999 | Chaves | |
| 6,202,771 | B1 | 3/2001 | Scott et al. | |
| 6,344,149 | B1 | 2/2002 | Oles | |
| 6,527,069 | B1 * | 3/2003 | Meiners et al. | 175/432 |
| 6,544,308 | B2 * | 4/2003 | Griffin et al. | 51/309 |
| 6,562,462 | B2 | 5/2003 | Griffin et al. | |
| 6,601,662 | B2 | 8/2003 | Matthias et al. | |

FOREIGN PATENT DOCUMENTS

| | | |
|---|---|---|
| JP | 61-270496 | 11/1986 |
| JP | 2000-096972 | 4/2000 |
| WO | WO 02/24437 A2 * | 5/2002 |

* cited by examiner

POLYCRYSTALLINE DIAMOND ABRASIVE ELEMENTS

BACKGROUND OF THE INVENTION

This invention relates to polycrystalline diamond abrasive elements.

Polycrystalline diamond abrasive elements, also known as polycrystalline diamond compacts (PDC), comprise a layer of polycrystalline diamond (PCD) generally bonded to a cemented carbide substrate. Such abrasive elements are used in a wide variety of drilling, wear, cutting, drawing and other such applications. PCD abrasive elements are used, in particular, as cutting inserts or elements in drill bits.

Polycrystalline diamond is extremely hard and provides an excellent wear-resistant material. Generally, the wear resistance of the polycrystalline diamond increases with the packing density of the diamond particles and the degree of interparticle bonding. Wear resistance will also increase with structural homogeneity and a reduction in average diamond grain size. This increase in wear resistance is desirable in order to achieve better cutter life. However, as PCD material is made more wear resistant it typically becomes more brittle or prone to fracture. PCD elements designed for improved wear performance will therefore tend to have compromised or reduced resistance to spalling.

With spalling-type wear, the cutting efficiency of the cutting inserts can rapidly be reduced and consequently the rate of penetration of the drill bit into the formation is slowed. Once chipping begins, the amount of damage to the table continually increases, as a result of the increased normal force now required to achieve the required depth of cut. Therefore, as cutter damage occurs and the rate of penetration of the drill bit decreases, the response of increasing weight on bit can quickly lead to further degradation and ultimately catastrophic failure of the chipped cutting element.

JP 59-219500 teaches that the performance of PCD tools can be improved by removing a ferrous metal binding phase in a volume extending to a depth of at least 0.2 mm from the surface of a sintered diamond body.

A PCD cutting element has recently been introduced on to the market which is said to have greatly improved cutter life, by increasing wear resistance without loss of impact strength. U.S. Pat. Nos. 6,544,308 and 6,562,462 describe the manufacture and behaviour of such cutters. The PCD cutting element is characterised inter alia, by a region adjacent the cutting surface which is substantially free of catalysing material. Catalysing materials for polycrystalline diamond are generally transition metals such as cobalt or iron.

In order to provide PCD abrasive elements with greater wear resistance than those claimed in the prior art previously discussed, it has been proposed to provide a mix of diamond particles, differing in their average particle size, in the manufacture of the PCD layers. U.S. Pat. Nos. 5,505,748 and 5,468,268 describe the manufacture of such PCD layers.

SUMMARY OF THE INVENTION

According to the present invention, there is provided a polycrystalline diamond abrasive element, particularly a cutting element, comprising a table of polycrystalline diamond having a working surface and bonded to a substrate, particularly a cemented carbide substrate, along an interface, the polycrystalline diamond abrasive element being characterised by:

i. the interface being non-planar having a cruciform configuration;

ii. the polycrystalline diamond having a high wear-resistance; and iii. the polycrystalline diamond having a region adjacent the working surface lean in catalysing material and a region rich in catalysing material.

The polycrystalline diamond table may be in the form of a single layer, which has a high wear resistance. This may be achieved, and is preferably achieved, by producing the polycrystalline diamond from a mass of diamond particles having at least three, and preferably at least five different particle sizes. The diamond particles in this mix of diamond particles are preferably fine.

The average particle size of the layer of polycrystalline diamond is preferably less than 20 microns, although adjacent the working surface it is preferably less than about 15 microns. In polycrystalline diamond, individual diamond particles are, to a large extent, bonded to adjacent particles through diamond bridges or necks. The individual diamond particles retain their identity, or generally have different orientations. The average particle size of these individual diamond particles may be determined using image analysis techniques. Images are collected on the scanning electron microscope and are analysed using standard image analysis techniques. From these images, it is possible to extract a representative diamond particle size distribution for the sintered compact.

The table of polycrystalline diamond may have regions or layers which differ from each other in their initial mix of diamond particles. Thus, there is preferably a first layer containing particles having at least five different average particle sizes on a second layer which has particles having at least four different average particle sizes.

The polycrystalline diamond table has a region adjacent the working surface which is lean in catalysing material. Generally, this region will be substantially free of catalysing material. The region will extend into the polycrystalline diamond from the working surface generally to a depth of no more than 500 microns.

The polycrystalline diamond table also has a region rich in catalysing material. The catalysing material is present as a sintering agent in the manufacture of the polycrystalline diamond table. Any diamond catalysing material known in the art may be used. Preferred catalysing materials are Group VII transition metals such as cobalt and nickel. The region rich in catalysing material will generally have an interface with the region lean in catalysing material and extend to the interface with the substrate.

The region rich in catalysing material may itself comprise more than one region. The regions may differ in average particle size, as well as in chemical composition. These regions, when provided will generally, but not exclusively, lie in planes parallel to the working surface of the polycrystalline diamond layer. In another example, the layers may be arranged perpendicular to the working surface, i.e., in concentric rings.

The polycrystalline diamond table typically has a maximum overall thickness of about 1 to about 3 mm, preferably about 2.2 mm as measured at the edge of the cutting tool. The PCD layer thickness will vary significantly from this throughout the body of the cutter as a function of the boundary with the non-planar interface.

The interface between the polycrystalline diamond table and the substrate is non-planar, and is preferably characterised in one embodiment by having a step at the periphery of the abrasive element defining a ring which extends around at least a part of the periphery of the abrasive element and into the substrate and a cruciform recess that extends into the substrate and intersecting the peripheral ring. In particular, the cruciform recess is cut into an upper surface of the substrate and a base surface of the peripheral ring.

In an alternative embodiment, the non-planar interface is characterised by having a step at the periphery of the abrasive element defining a ring which extends around at least a part of the periphery of the abrasive element and into the substrate and a cruciform recess that extends into the substrate and is confined within the bounds of the step defining the peripheral ring. Further, the peripheral ring includes a plurality of indentations in a base surface thereof, each indentation being located adjacent respective ends of the cruciform recess.

According to another aspect of the invention, a method of producing a PCD abrasive element as described above includes the steps of creating an unbonded assembly by providing a substrate having a non-planar surface and having a cruciform configuration, placing a mass of diamond particles on the non-planar surface, the mass of diamond particles containing particles having at least three, and preferably at least five, different average particle sizes, providing a source of catalysing material for the diamond particles, subjecting the unbonded assembly to conditions of elevated temperature and pressure suitable for producing a polycrystalline diamond table of the mass of diamond particles, such table being bonded to the non-planar surface of the substrate, and removing catalysing material from a region of the polycrystalline diamond table adjacent an exposed surface thereof.

The substrate will generally be a cemented carbide substrate. The source of catalysing material will generally be the cemented carbide substrate. Some additional catalysing material may be mixed in with the diamond particles.

The diamond particles contain particles having different average particle sizes. The term "average particle size" means that a major amount of particles will be close to the particle size, although there will be some particles above and some particles below the specified size.

Catalysing material is removed from a region of the polycrystalline diamond table adjacent to an exposed surface thereof. Generally, that surface will be on a side of the polycrystalline diamond table opposite to the non-planar surface and will provide a working surface for the polycrystalline diamond table. Removal of the catalysing material may be carried out using methods known in the art such as electrolytic etching and acid leaching.

The conditions of elevated temperature and pressure necessary to produce the polycrystalline diamond table from a mass of diamond particles are well known in the art. Typically, these conditions are pressures in the range 4 to 8 GPa and temperatures in the range 1300 to 1700° C.

Further according to the invention, there is provided a rotary drill bit containing a plurality of cutter elements, substantially all of which are PCD abrasive elements, as described above.

It has been found that the PCD abrasive elements of the invention have significantly higher wear resistance, impact strength and hence significantly increased cutter life than PCD abrasive elements of the prior art.

DETAILED DESCRIPTION OF THE INVENTION

The polycrystalline diamond abrasive elements of the invention have particular application as cutter elements for drill bits. In this application, they have been found to have excellent wear resistance and impact strength. These properties allow them to be used effectively in drilling or boring of subterranean formations having high compressive strength.

Figure 1:
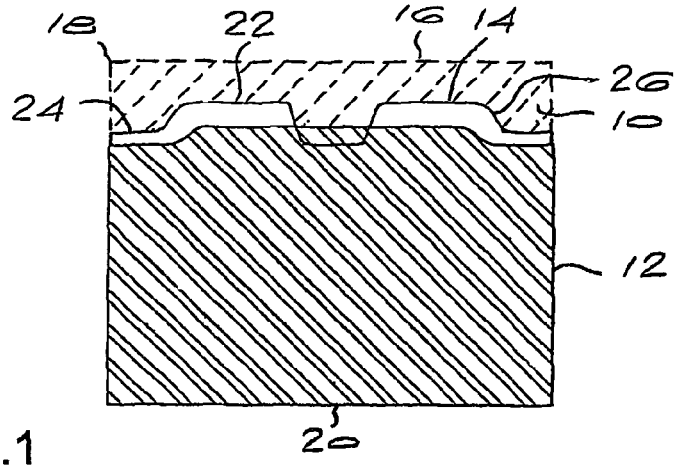
FIG. 1 is a sectional side view of a first embodiment of a polycrystalline diamond abrasive element of the invention.
Figure 2:
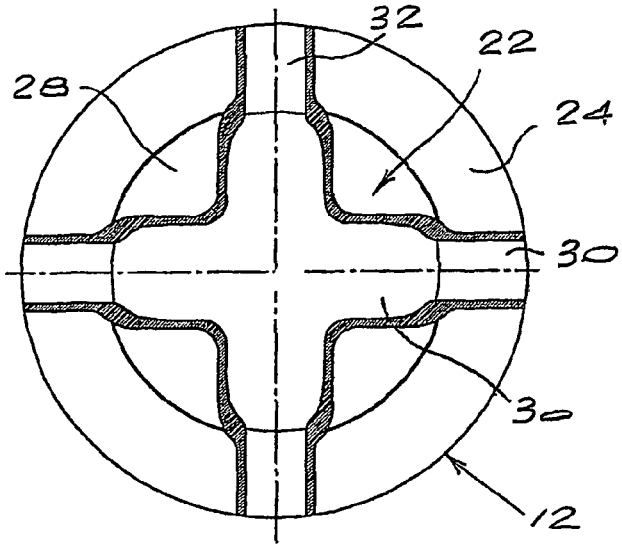
FIG. 2 is a plan view of the cemented carbide substrate of the polycrystalline diamond abrasive element of FIG. 1.
Figure 3:
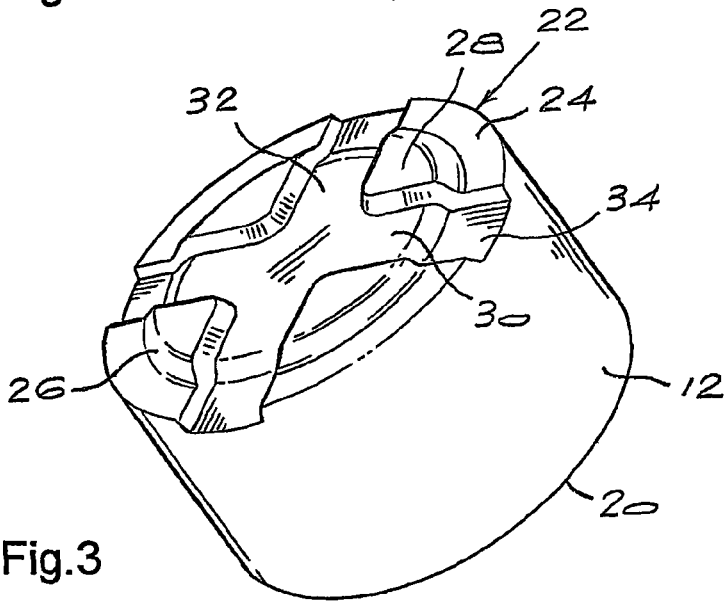
FIG. 3 is a perspective view of the cemented carbide substrate of the polycrystalline diamond abrasive element of FIG. 1.
Figure 4:
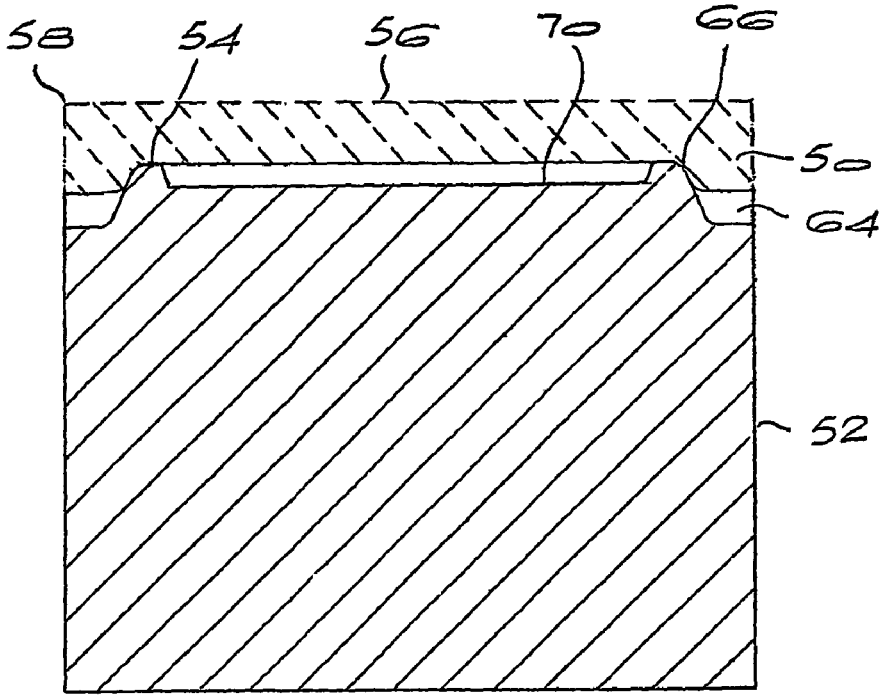
FIG. 4 is a sectional side view of a second embodiment of a polycrystalline diamond abrasive element of the invention.
Figure 5:
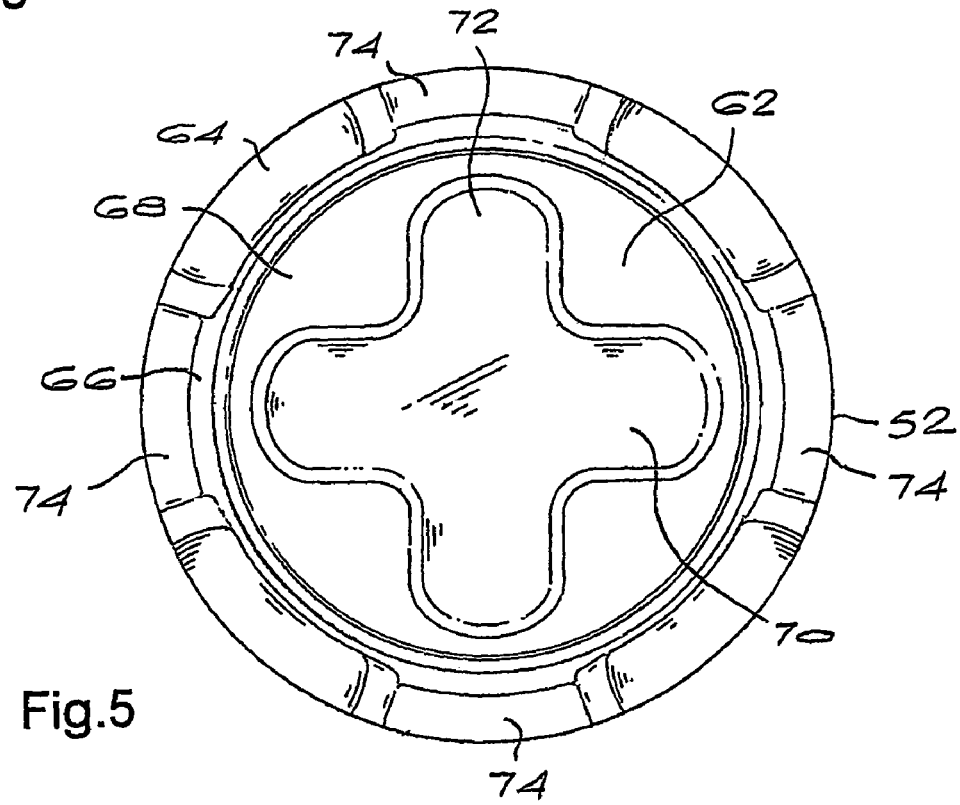
FIG. 5 is a plan view of the cemented carbide substrate of the polycrystalline diamond abrasive element of FIG. 4.
Figure 6:
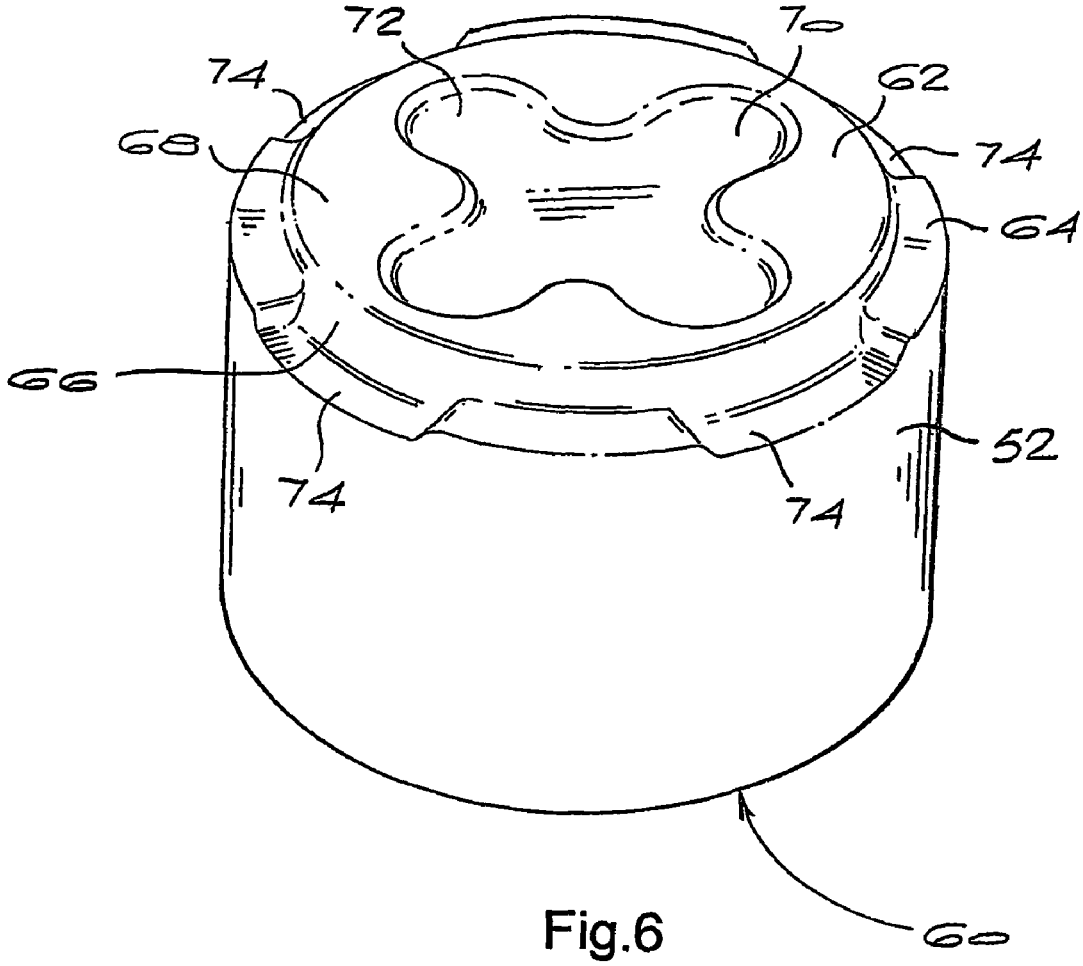
FIG. 6 is a perspective view of the cemented carbide substrate of the polycrystalline diamond abrasive element of FIG. 4.

Embodiments of the invention will now be described. FIGS. 1 to 3 illustrate a first embodiment of a polycrystalline diamond abrasive element of the invention and FIGS. 4 to 6 illustrate a second embodiment thereof. In these embodiments, a layer of polycrystalline diamond is bonded to a cemented carbide substrate along a non-planar or profiled interface.

Referring first to FIG. 1, a polycrystalline diamond abrasive element comprises a layer 10 of polycrystalline diamond (shown in phantom lines) bonded to a cemented carbide substrate 12 along an interface 14. The polycrystalline diamond layer 10 has an upper working surface 16 which has a cutting edge 18. The edge is illustrated as being a sharp edge. This edge can also be bevelled. The cutting edge 18 extends around the entire periphery of the surface 16.

FIGS. 2 and 3 illustrate more clearly the cemented carbide substrate used in the first embodiment of the invention shown in FIG. 1. The substrate 12 has a flat bottom surface 20 and a profiled upper surface 22, which generally has a cruciform configuration. The profiled upper surface 22 has the following features:

i. A stepped peripheral region defining a ring 24. The ring 24 has a sloping surface 26 which connects an upper flat surface or region 28 of the profiled surface 22.

ii. Two intersecting grooves 30, 32, which define a cruciform recess, that extend from one side of the substrate to the opposite side of the substrate. These grooves are cut through the upper surface 28 and also through the base surface 34 of the ring 24.

Referring now to FIG. 4, a polycrystalline diamond abrasive element of a second embodiment of the invention comprises a layer 50 of polycrystalline diamond (shown in phantom lines) bonded to a cemented carbide substrate 52 along an interface 54. The polycrystalline diamond layer 50 has an upper working surface 56, which has a cutting edge 58. The edge is illustrated as being a sharp edge. This edge can also be bevelled. The cutting edge 58 extends around the entire periphery of the surface 56.

FIGS. 5 and 6 illustrate more clearly the cemented carbide substrate used in the second embodiment of the invention, as shown in FIG. 4. The substrate 52 has a flat bottom surface 60 and a profiled upper surface 62. The profiled upper surface 62 has the following features:

i. A stepped peripheral region defining a ring 64. The ring 64 has a sloping surface 66 which connects an upper flat surface or region 68 of the profiled surface.

ii. Two intersecting grooves 70, 72 forming a cruciform formation in the surface 68.

iii. Four cut-outs or indentations 74 in the ring 64 located opposite respective ends of the grooves 70, 72.

In the embodiments of FIGS. 1 to 6, the polycrystalline diamond layers 10, 50 have a region rich in catalysing material and a region lean in catalysing material. The region lean in catalysing material will extend from the respective working surface 16, 56 into the layer 10, 50. The depth of this region will typically be no more than 500 microns. Typically, if the PCD edge is bevelled, the region lean in catalysing material will generally follow the shape of this bevel and extend along the length of the bevel. The balance of the polycrystalline diamond layer 10, 50 extending to the profiled surface 22, 62 of the cemented carbide substrate 12, 52 will be the region rich in catalysing material.

Generally, the layer of polycrystalline diamond will be produced and bonded to the cemented carbide substrate by methods known in the art. Thereafter, catalysing material is removed from the working surface of the particular embodiment using any one of a number of known methods. One such method is the use of a hot mineral acid leach, for example a hot hydrochloric acid leach. Typically, the temperature of the acid will be about 110° C. and the leaching times will be 24 to 60 hours. The area of the polycrystalline diamond layer which is intended not to be leached and the carbide substrate will be suitably masked with acid resistant material.

In producing the polycrystalline diamond abrasive elements described above, and as illustrated in the preferred embodiments, a layer of diamond particles, optionally mixed with some catalysing material, will be placed on the profiled surface of a cemented carbide substrate. This unbonded assembly is then subjected to elevated temperature and pressure conditions to produce polycrystalline diamond of the diamond particles bonded to the cemented carbide substrate. The conditions and steps required to achieve this are well known in the art.

The diamond layer will comprise a mix of diamond particles, differing in average particle sizes. In one embodiment, the mix comprises particles having five different average particle sizes as follows:

| Average Particle Size (in microns) | Percent by mass |
|---|---|
| 20 to 25 (preferably 22) | 25 to 30 (preferably 28) |
| 10 to 15 (preferably 12) | 40 to 50 (preferably 44) |
| 5 to 8 (preferably 6) | 5 to 10 (preferably 7) |
| 3 to 5 (preferably 4) | 15 to 20 (preferably 16) |
| less than 4 (preferably 2) | Less than 8 (preferably 5) |

In a particularly preferred embodiment, the polycrystalline diamond layer comprises two layers differing in their mix of particles. The first layer, adjacent the working surface, has a mix of particles of the type described above. The second layer, located between the first layer and the profiled surface of the substrate, is one in which (i) the majority of the particles have an average particle size in the range 10 to 100 microns, and consists of at least three different average particle sizes and (ii) at least 4 percent by mass of particles have an average particle size of less than 10 microns. Both the diamond mixes for the first and second layers may also contain admixed catalyst material.

Polycrystalline diamond cutter elements were produced with cemented carbide substrates having profiled surfaces generally of the type illustrated by FIGS. 1 to 3. In one embodiment, a diamond particle mix was used in producing the polycrystalline diamond layer which had particles having five different particle sizes, as described in the preferred embodiment above, and having a general thickness of about 2.2 mm. The average diamond particle size of the polycrystalline diamond layer was found to be 10.3 μm after sintering. This polycrystalline diamond cutter element will be designated "Cutter A".

A second polycrystalline diamond element was produced, again using a cemented carbide substrate having a profiled surface substantially as illustrated by FIGS. 1 to 3. The diamond mix used in producing the polycrystalline diamond table in this embodiment consisted of two layers. The mix of particles in the two layers was as described in respect of the particularly preferred embodiment above, and once again had a general thickness of about 2.2 mm. The average overall diamond particle size, in the polycrystalline diamond layer, was found to be 15 μm after sintering. This polycrystalline diamond cutter element will be designated "Cutter B"

A third polycrystalline diamond element was produced, using a cemented carbide substrate having a profiled surface substantially as illustrated by FIGS. 4 to 6. The diamond mix used in producing the polycrystalline diamond table in this embodiment consisted of two layers. The mix of particles in the two layers was as described in respect of the particularly preferred embodiment above, and once again had a general thickness of about 2.2 mm. The average overall diamond particle size, in the polycrystalline diamond layer, was found to be 15 μm after sintering. This polycrystalline diamond cutter element will be designated "Cutter C".

Each of the polycrystalline diamond cutter elements A, B and C had catalysing material, in this case cobalt, removed from the working surface thereof to create a region lean in catalysing material. This region extended below the working surface to an average depth of about 250 μm. Typically, the range for this depth will be +/−50 μm, giving a range of about 200-about 300 μm for the region lean in catalysing material across a single cutter.

The leached cutter elements A, B and C were then compared in a vertical borer test with a commercially available polycrystalline diamond cutter element having similar characteristics, i.e. a region immediately below the working surface lean in catalysing material, designated in each case as "Prior Art cutter A". This cutter does not have the high wear resistance PCD, optimised table thickness or substrate design of cutter elements of this invention. A vertical borer test is an application-based test where the wear flat area (or amount of PCD worn away during the test) is measured as a function of the number of passes of the cutter element boring into the work piece, which equates to a volume of rock removed. The work piece in this case was granite. This test can be used to evaluate cutter behaviour during drilling operations. The results obtained are illustrated graphically in FIGS. 7 and 8.

Figure 7:
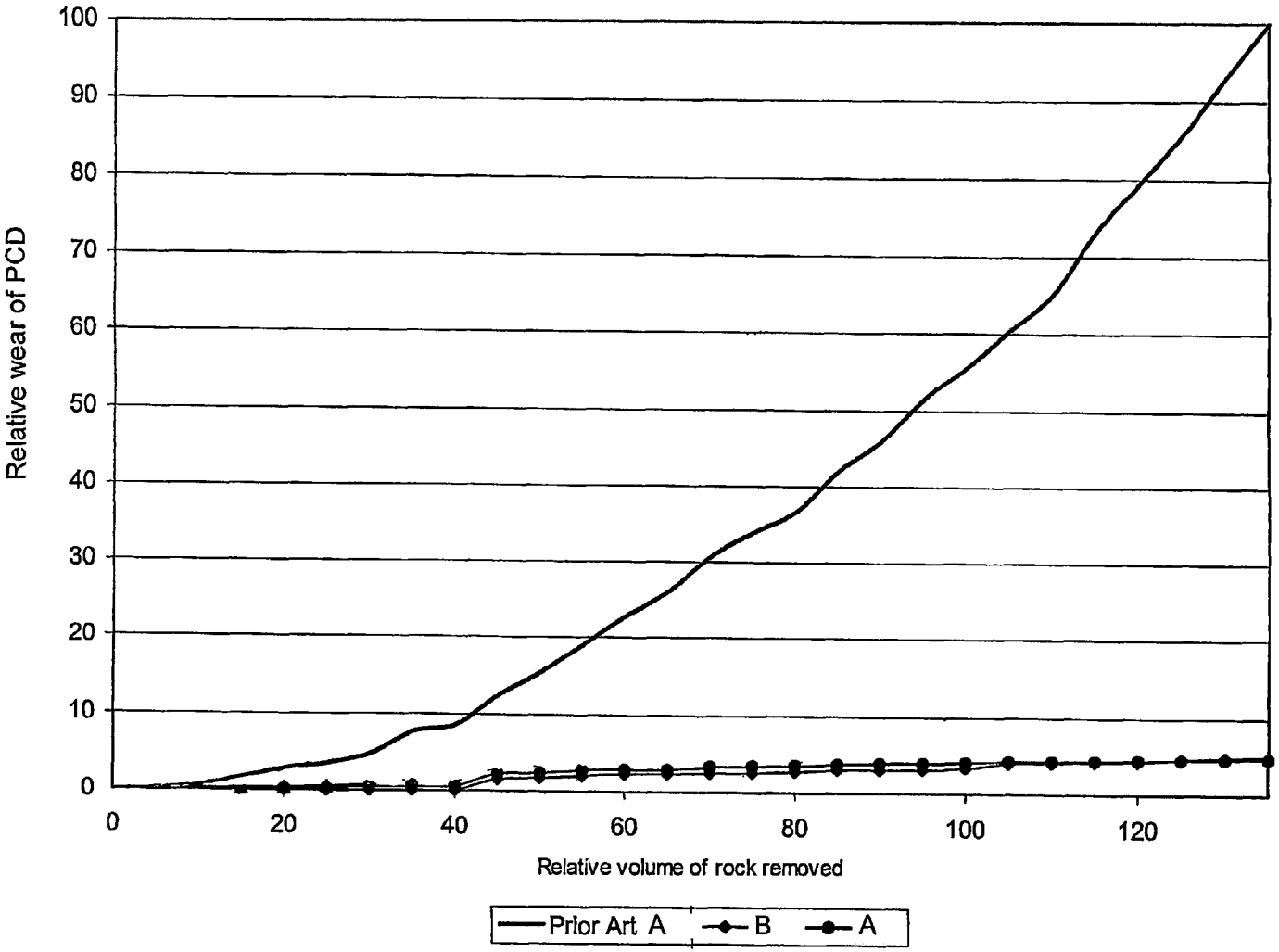
FIG. 7 is a graph showing comparative data in a first series of vertical borer tests using different polycrystalline diamond abrasive elements.

FIG. 7 compares the relative performance of Cutters A and B of this invention with the commercially available Prior Art cutter A. As these curves show the amount of PCD material removed as a function of the amount of rock removed in the test, the flatter the gradient of the curve, the better the performance of the cutters. Both cutters of the invention show a marked improvement in wear rate over the prior art cutter. From FIG. 7 it is evident that for the same amount of PCD wear, the cutters of this invention will remove significantly more rock than that which is removed by the Prior Art cutter A. Note too the reduction in the undulations of the wear curve. This indicates control of the continuous spalling wear phenomenon.

Figure 8:
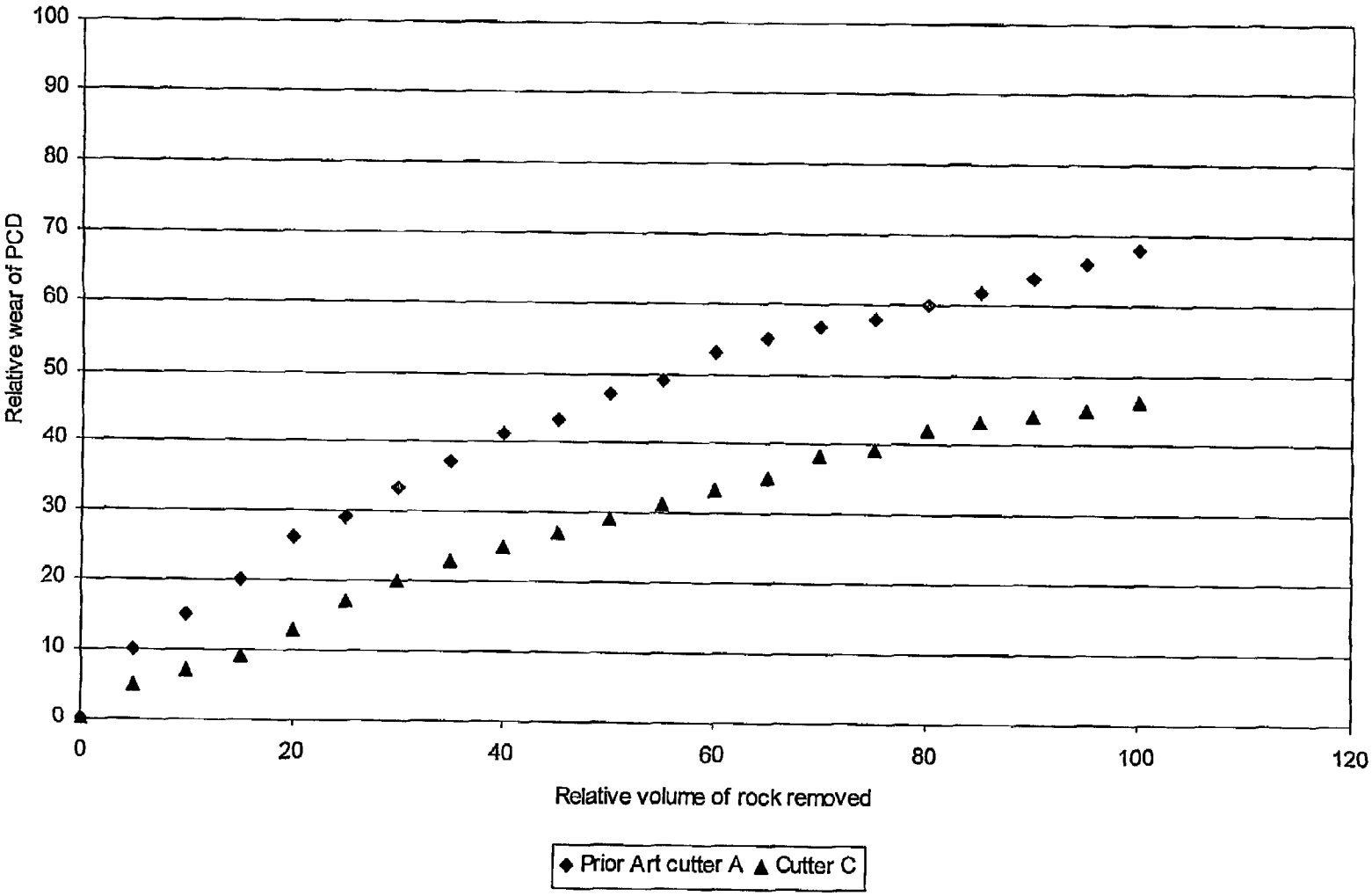
FIG. 8 is a graph showing comparative data in a second series of vertical borer tests using different polycrystalline diamond abrasive elements.

FIG. 8 compares the relative performance of Cutter C of the invention with that of the commercially available Prior Art cutter A. Note that this cutter also shows a marked improvement over the prior art cutter.

It will also be noted from FIGS. 7 and 8, that a larger wear flat area developed much more quickly on the prior art cutter element than any of the cutter elements A, B or C of the invention. The larger the wear flat area generated, the more difficult it is to bore or cut. This will necessitate an increase in weight on bit in order to achieve an acceptable rate of cutting. This in turn induces higher stresses within the cutter element, resulting in a further reduction in life. Even after extended boring, the cutter elements of this invention had not developed significant wear flat areas, whereas the prior art cutter had done so. An added advantage of the reduced wear-flat size in these cutters, is that a higher rate of penetration can be achieved with the same weight on bit. Thus cutters exhibiting this type of behaviour can also achieve higher rates of penetration, as well as extended useful life, in a drilling application.

The invention claimed is:

1. A polycrystalline diamond abrasive element, comprising:

a table of polycrystalline diamond having a working surface and bonded to a substrate along an interface, the substrate comprising a profiled upper surface at the interface including a flat peripheral ring with a sloping surface at a radially inner boundary thereof extending upwardly to a flat surface, and a cruciform recess comprising diametrically located grooves in the flat surface extending across a center of the profiled upper surface, the sloping surface and a base surface of the peripheral ring and substantially following a contour of the profiled upper surface corresponding to the flat surface, the sloping surface and the base surface of the peripheral ring; and the polycrystalline diamond table having a region adjacent the working surface lean in catalysing material and a region rich in catalysing material.

2. An element according to claim 1, wherein the polycrystalline diamond table is in the form of a single layer and is produced from a mass of diamond particles having at least three different average particle sizes.

3. An element according to claim 2, wherein the polycrystalline diamond layer is produced from a mass of diamond particles having at least five different average particle sizes.

4. An element according to claim 1, wherein the table of polycrystalline diamond comprises a first layer defining the working surface and a second layer located between the first layer and the substrate, the first layer of polycrystalline diamond having a higher wear resistance than the second layer of polycrystalline diamond.

5. An element according to claim 4, wherein the first layer of polycrystalline diamond is produced from a mass of diamond particles having at least five different average particle sizes and the second layer is produced from a mass of diamond particles having at least four different average particle sizes.

6. An element according to claim 1, wherein the average particle size of the polycrystalline diamond is less than 20 microns.

7. An element according to claim 6, wherein the average particle size of the polycrystalline diamond adjacent the working surface is less than about 15 microns.

8. An element according to claim 1, wherein the polycrystalline diamond table has a maximum overall thickness of about 1 to about 3 mm.

9. An element according to claim 8, wherein the polycrystalline diamond table has a general thickness of about 2.2 mm.

10. An element according to claim 1, wherein the diamond abrasive element is a cutting element.

11. An element according to claim 1, wherein the substrate is a cemented carbide substrate.

* * * * *